US008439598B2

(12) United States Patent
Norton

(10) Patent No.: US 8,439,598 B2
(45) Date of Patent: May 14, 2013

(54) OSCILLATORY COMPACTION METHOD

(75) Inventor: Mark L. Norton, Eden Prairie, MN (US)

(73) Assignee: Caterpillar Inc., Peoria, IL (US)

( * ) Notice: Subject to any disclaimer, the term of this patent is extended or adjusted under 35 U.S.C. 154(b) by 131 days.

(21) Appl. No.: 12/968,876

(22) Filed: Dec. 15, 2010

(65) Prior Publication Data

US 2012/0155961 A1 Jun. 21, 2012

(51) Int. Cl.
*E01C 19/22* (2006.01)

(52) U.S. Cl.
USPC ..... 404/75; 404/84.1

(58) Field of Classification Search ..... 404/72, 404/75, 84.1, 117, 122, 128
See application file for complete search history.

(56) References Cited

U.S. PATENT DOCUMENTS

| | | | | |
|---|---|---|---|---|
| 3,599,543 | A | 8/1971 | Kerridge | |
| 3,683,763 | A * | 8/1972 | Keppler et al. | 404/117 |
| 3,814,531 | A * | 6/1974 | Carnahan et al. | 404/117 |
| 3,814,532 | A | 6/1974 | Barrett et al. | |
| 3,848,690 | A * | 11/1974 | Hawkins | 180/6.48 |
| 3,868,194 | A * | 2/1975 | Ferguson et al. | 404/126 |
| 4,003,203 | A | 1/1977 | Vural | |
| 4,029,165 | A * | 6/1977 | Miller et al. | 180/6.48 |
| 4,041,623 | A * | 8/1977 | Miller et al. | 37/382 |
| 4,109,742 | A * | 8/1978 | Fairchild et al. | 180/20 |
| 4,127,351 | A * | 11/1978 | Vural | 404/72 |
| 4,149,253 | A * | 4/1979 | Paar et al. | 701/50 |
| 4,156,575 | A * | 5/1979 | Konig et al. | 404/84.05 |
| 4,157,877 | A * | 6/1979 | Lee | 404/128 |
| 4,187,036 | A | 2/1980 | Haker et al. | |
| 4,209,988 | A * | 7/1980 | Langworthy et al. | 60/431 |
| 4,493,585 | A | 1/1985 | Axer | |
| 4,710,054 | A * | 12/1987 | Allen | 404/110 |
| 4,779,418 | A * | 10/1988 | Artzberger | 60/444 |
| 4,878,544 | A | 11/1989 | Barnhart | |
| 5,046,891 | A | 9/1991 | Vural | |
| 5,337,833 | A * | 8/1994 | Rizzo | 172/520 |
| 5,618,133 | A * | 4/1997 | Mitsui et al. | 404/117 |
| 5,727,900 | A * | 3/1998 | Sandstrom | 404/84.1 |
| 5,735,634 | A | 4/1998 | Ulrich et al. | |
| 5,781,874 | A * | 7/1998 | Troppman et al. | 701/50 |
| 6,129,481 | A * | 10/2000 | Tapio et al. | 404/102 |
| 6,558,072 | B2 | 5/2003 | Staffenhagen et al. | |
| 6,637,280 | B2 | 10/2003 | Potts | |
| 6,712,550 | B2 * | 3/2004 | Fervers | 404/122 |
| 6,742,960 | B2 | 6/2004 | Corcoran et al. | |
| 6,769,838 | B2 * | 8/2004 | Potts | 404/117 |
| 6,827,524 | B2 * | 12/2004 | Starry et al. | 404/129 |
| 6,829,986 | B2 | 12/2004 | Richter | |
| 7,168,885 | B2 * | 1/2007 | Rio et al. | 404/72 |

(Continued)

FOREIGN PATENT DOCUMENTS

| | | |
|---|---|---|
| GB | 735898 | 8/1955 |
| GB | 1346895 | 2/1974 |

*Primary Examiner* — Gary S Hartmann
(74) *Attorney, Agent, or Firm* — Miller, Matthias & Hull

(57) ABSTRACT

A method for compacting a surface of granular materials is disclosed. The method is applicable to wheeled compaction equipment such as pneumatic-tire compactors, drum-type compactors and asphalt compactors. The propel system includes a controller programmed to send a first at least substantially constant propel command that propels the compaction equipment in a forward direction. The controller then changes the speed of the compaction equipment by providing a second varying propel command that may increase or decrease the speed resulting from the first command. As a result, the speed of the compaction equipment oscillates.

15 Claims, 3 Drawing Sheets

U.S. PATENT DOCUMENTS

| | | | | |
|---|---|---|---|---|
| 7,623,951 | B2 * | 11/2009 | Congdon et al. | 701/50 |
| 8,116,950 | B2 * | 2/2012 | Glee | 701/50 |
| 2002/0172556 | A1 | 11/2002 | Staffenhagen | |
| 2008/0292401 | A1 | 11/2008 | Potts | |
| 2009/0133951 | A1 | 5/2009 | Schultz et al. | |
| 2009/0143952 | A1 * | 6/2009 | Chisholm et al. | 701/99 |
| 2009/0314571 | A1 | 12/2009 | Fausch | |

* cited by examiner

OSCILLATORY COMPACTION METHOD

TECHNICAL FIELD

This disclosure relates generally to the compaction of asphalt, soil and granular materials using drum-type compactors and pneumatic-tire compactors.

BACKGROUND

A road roller, roller-compactor, asphalt compactor, pneumatic compactor or simply a "roller" are a compactor type vehicles used to compact soil, gravel, concrete, or asphalt in the construction of roads and foundations. Two types of compactors will be discussed here: pneumatic tire compactors and drum vibratory compactors, also known as asphalt compactors because of their predominant use on asphalt. Both types of compactors do the same type of work in different ways.

Drum vibratory compactors offer contractors a high productivity solution for finishing asphalt. In the vibratory mode, drum compactors quickly increase the density of fresh asphalt and are usually the preferred machine for the initial breakdown pass in most applications. After the breakdown pass, either a drum or a pneumatic-tire compactor is used to continue compaction. Tandem steel-drum machines, with their ability to vibrate the surface, may achieve the required level of density in roughly half the number of passes as a pneumatic-tire machine in the intermediate rolling applications.

One key difference is that steel drums leave behind a surface that is more permeable and open textured. Many state departments of transportation are using permeable asphalt pavements designed to let rain migrate through the top asphalt layer to drainage channels underneath. In areas with high rainfall amounts, the open texture is often specified because this type of road surface is better at reducing standing water and spray from passing vehicles. Open-texture asphalt pavements also give vehicles better traction and skid resistance.

One the other hand, pneumatic-tire compactors are only half as productive as tandem-drum vibratory compactors in the intermediate applications as a general rule. However, pneumatic tire compactors still play an important role in asphalt compaction. First, pneumatic-tire compactors create a smooth, impermeable wear layer. While the textured wear layers that steel drums create are gaining favor in some states, only about 15% of roadways are designed with this textured wear layers in the specifications. Smooth, impermeable wear layers drain water to the sides and prevent the water from weakening the sub-base.

Pneumatic-tire compactors are much preferred when compacting naturally occurring soils, crushed stone and chip-seal surfaces because steel drums tend to fracture these types of stone. Also, the working speed of pneumatic compactors, many of which can run from 4 to 8 mph is higher than that of a drum compactor.

Because paving trains of road construction crews are moving at faster speeds, the compaction equipment, both drum (asphalt) and pneumatic-tire compactors must, by design, keep up with paving trains for efficiency. There have been significant improvements in compaction equipment during the past decade, especially with vibratory drums, which usually rely upon an eccentric weight system within the drums. Pneumatic-tire compactors have also evolved to include hydrostatic drive systems and improved tires.

However, improvements in compaction of soils and paving materials are always desirable in terms of both the quality of compaction and the speed of compaction.

SUMMARY OF THE DISCLOSURE

For purposes of this disclosure, wheeled compaction equipment will include both pneumatic-tire compactors as well as drum-type or asphalt compactors.

Various methods for compacting surfaces are disclosed. One disclosed method includes providing wheeled compaction equipment and providing a first at least substantially constant propel command that propels the equipment in a forward direction. The method further includes providing a second varying propel command to vary a speed of the equipment that set by the first at least substantially constant propel command. In such a method, the equipment maintains its motion in the forward direction despite varying the forward speed of the equipment.

A hydraulically driven compactor is also disclosed which includes at least two wheels for propelling the compactor and for compacting materials disposed beneath the wheels. The wheels are in communication with a hydraulic motor. The hydraulic motor is in communication with a control valve. The control valve is in communication with a hydraulic pump that is in communication with a hydraulic fluid reservoir. The compactor also includes a controller for controlling the flow of hydraulic fluid through the control valve. The controller includes a memory programmed with at least two commands: a first at least substantially constant propel command that propels the compactor in a forward direction; and a second varying propel command to vary a speed of the compactor set by the first at least substantially constant propel command.

An electrically driven compactor is also disclosed. The disclosed electrically driven compactor includes at least two wheels for propelling the compactor and for compacting materials disposed beneath the wheels. The wheels are coupled to an electric motor. The electric motor is linked to a power source. The electrically driven compactor also includes a controller for varying current transmitted from the power source to the electric motor. The controller includes a memory programmed with at least two commands including a first at least substantially constant propel command that propels the compactor in a forward direction and a second varying propel command to vary the speed of the compactor set by the first at least substantially constant propel command.

In any of the embodiments discussed above, the equipment or compactor maybe a pneumatic-tire compactor or a drum-type compactor. In any of the embodiments discussed above, the first at least substantially constant propel command may provide an at least substantially constant pressurized flow of hydraulic fluid to a hydraulic motor that propels the wheeled compaction equipment forward. Further, the second varying propel command may provide a varying current to a control valve disposed upstream of the hydraulic motor that varies the flow of hydraulic fluid to the hydraulic motor to vary the speed of the equipment compactor set by the first at least substantially constant propel command. In any of the embodiments discussed above, the control valve may be a proportional control valve.

Alternatively, the first at least substantially constant propel command provides an at least substantially constant current that propels the equipment or compactor forward. The second varying propel command may provide a varying current to the electric motor of the equipment or compactor to vary the speed of the equipment or compactor set by the first at least substantially constant propel command.

DETAILED DESCRIPTION

It has been surprisingly found that varying the speed of compacting equipment while maintaining a continual forward direction improves compaction, reduces the time it takes to achieve a satisfactory compaction and helps the compaction equipment or compaction process keep up with today's faster paving trains of road construction crews.

Two types of compaction equipment will be discussed herein, but it will be understood by those skilled in the art that the techniques and methods disclosed herein are applicable to other types of compaction equipment.

Figure 1:
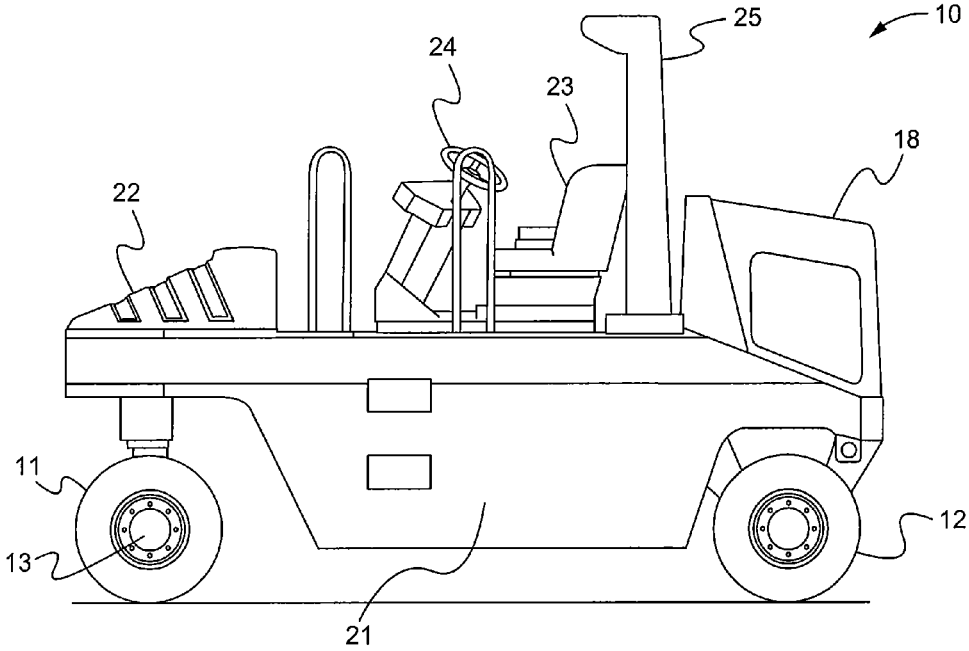
FIG. 1 is a side elevational view of a pneumatic-tire compactor made in accordance with this disclosure.
Figure 2:
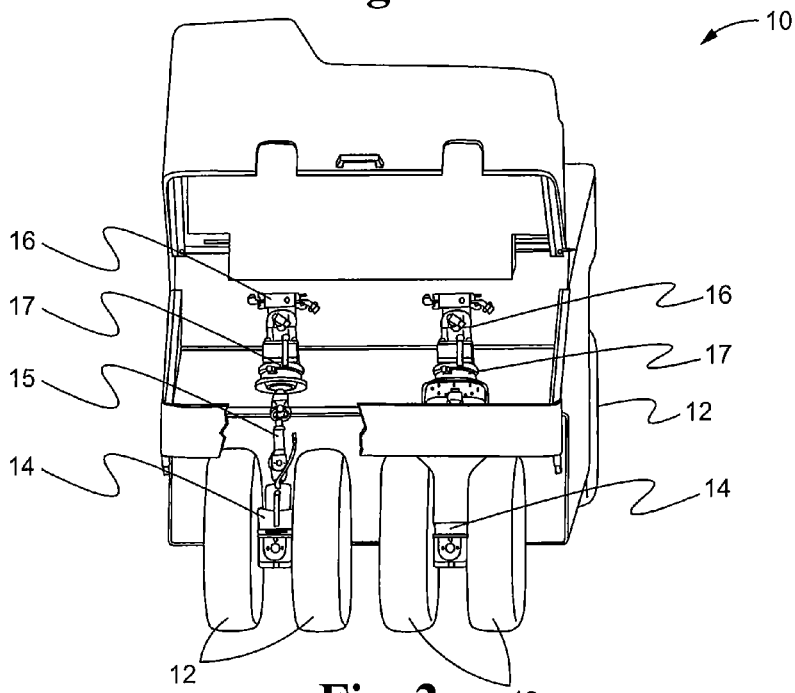
FIG. 2 is a rear sectional view of the pneumatic-tire compactor shown in FIG. 1.
Figure 5:
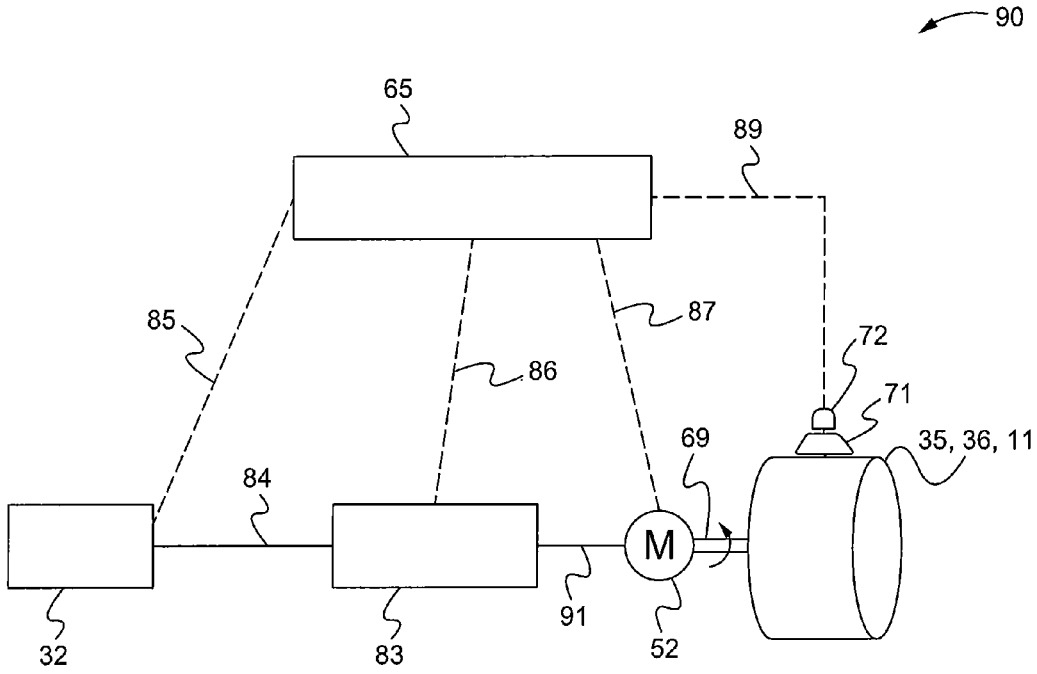
FIG. 5 is a simplified schematic circuit diagram for a simplified electric circuit made in accordance with this disclosure.

Turning to FIG. 1, a pneumatic-tire compactor 10 is shown that includes a plurality of front tires 11 (see also FIG. 2) and rear tires 12. The front tires 11 are supported by a front axle 13 while each pair of the rear tires 12 are supported by an axle planetary drive 14 that is connected to the end of a drive line 15 which, in turn, is coupled to a hydraulic motor 16 (FIG. 2). While the compactor 10 illustrated in FIGS. 1 and 2 includes hydraulic motors 16 for purposes of propelling the front tires 11, electric drive systems are available and considered within the scope of this disclosure as illustrated in FIG. 5.

Returning to FIG. 1, the pneumatic-tire compactor includes an engine enclosure 18 mounted on a frame 21. In the example illustrated in FIG. 1, the frame 21 is unitary in structure. However an articulated frame is also applicable to the concepts disclosed herein. The internal combustion engine (not shown) housed within the enclosure 18 provides the requisite pressurized hydraulic fluid to drive the hydraulic motors 16 shown in FIG. 2 and which are enclosed by the enclosure 22 shown in FIG. 1. The compactor 10 also includes a seat 23 for an operator as well as the steering wheel 24. A rollover protector is shown at 25.

Figure 3:
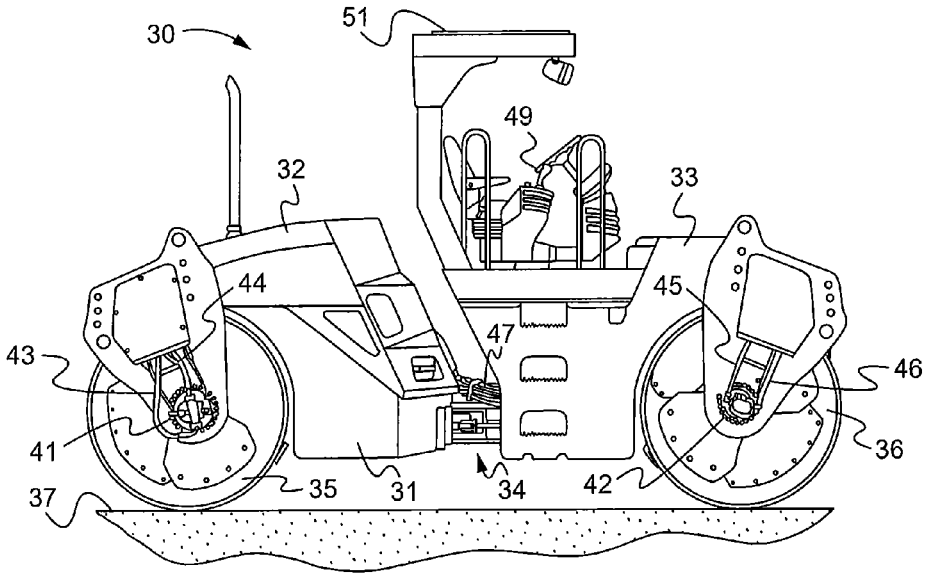
FIG. 3 is a side elevational view of a drum-type or asphalt compactor.

Turning to FIG. 3, a drum-type compactor 30, also known as an asphalt compactor, is shown. The compactor 30 includes a rear frame 31 that supports an engine 32 and a front frame 33 that is coupled to the rear frame 31 by a link 34 to provide an articulated chassis. The link or joint 34 provides pivoting motion between the frames 31, 33 to permit steering of the compactor 30. Each frame includes one or more wheels 35, 36 that, in this embodiment, can be classified as drums. While this disclosure refers to the drums 35, 36 as drums and the tires 11, 12 of FIG. 1 as tires, it will be noted that disclosure is applicable to wheels and wheeled vehicles in a broader sense. Each drum 35, 36 contacts the supporting surface 37 and supports the compactor 30 allowing it to travel along the surface 37. Each drum or roller 35, 36 are capable of being powered by a hydraulic motor 41, 42. The hydraulic motors 41, 42 receive a flow of hydraulic fluid through one of the conduits 43, 44 or 45, 46 respectively. Each hydraulic motor 41, 42 can operate its respective drum or roller 35, 36 in either direction depending on the direction of flow through the conduits 43, 44 or 45, 46.

The flow of fluid through the conduits 43, 44 or 45, 46 is driven by one or more pumps (not shown in FIG. 3) which is operated by the engine 32. The engine 32 and pump (not shown in FIG. 3) operate both hydraulic motors 41, 42 in the embodiments shown in FIG. 3. Thus, intermediate lines 47 communicate hydraulic fluid between the engine 32 and pump (not shown) and the front hydraulic motor 42. One example of a pump is the variable displacement pump 48 shown in FIG. 4. The pump 48 (FIG. 4) is controlled by the lever 49 (FIG. 3) position within the cab portion 51 of the compactor 30 as shown in FIG. 3.

Again, while FIG. 3 illustrates the compactor 30 with hydraulically driven drums 35, 36, the drums 35, 36 may be driven by an electric motor 52 as shown and explained below in connection with FIG. 5. The tires 12 of the compactor 10 may also be driven by such an electric motor 52 as well.

Figure 4:
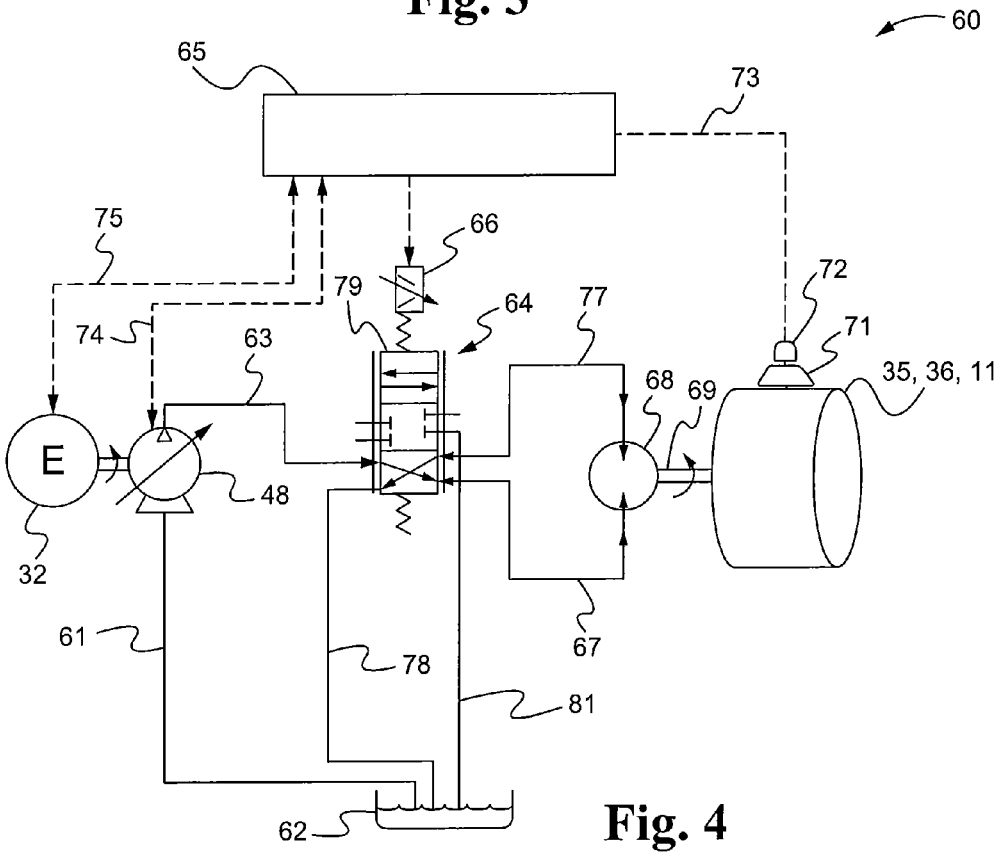
FIG. 4 is a schematic circuit diagram of a simplified hydraulic circuit made in accordance with this disclosure.

Returning to a hydraulic drive system, a simplified circuit diagram for a hydraulic system 60 is illustrated in FIG. 4. The hydraulic system 60, as shown, is simplified to illustrate the driving of only one drum or tire 35, 36, 12. The hydraulic components needed to drive the other drums or tires or vibrators within each drum or tire are not shown for the sake of simplicity. Further, similar hydraulic components may also be provided in alternative hydrostatically driven vehicles to perform operations such as lifting or tilting of attached implements.

The hydraulic system 60 includes a variable displaced pump 48 connected to the engine 32 which, in this case, can also be referred to as a prime mover. The pump 48 has an inlet conduit 61 that is in communication with a fluid reservoir or drain 62. When the engine 32 is operating, the pump 48 draws a flow of fluid from the reservoir 62 through the conduit 61 and pressurizes it before sending it through the conduit 63 to the proportional directional control valve 64. The control valve 64 is controlled by the controller 65 which sends a signal to the actuator 66. The actuator 66 moves the valve 64 to one of three positions.

In FIG. 4, the valve 64 provides communication from the conduit 63 to the conduit 67 that leads to the by directional hydraulic motor 68. Pressurized fluid drives the motor 68 which turns the drive line or axle 69 which, in turn, drives the drum or wheel 35, 36, 12. The controller 65 is also linked to the brake 71 by way of an actuator 72 and the communication line 73. The controller 65 is also linked to the pump 48 via the communication line 74 and to the engine 32 via the communication line 75.

In the position shown in FIG. 4, the pump 48 draws fluid from the reservoir 62 and through the conduit 61 before delivering high pressure fluid through the conduit 63 to the control valve 64. In the position shown in FIG. 4, fluid passes through the control valve 64 to the conduit 67 and onto the hydraulic motor 68 which rotates the axle or drive line 69. Fluid is returned through the conduit 77, through the valve 64 and through the drain conduit 78 back to the reservoir 62. A reverse flow can be achieved by moving the spool 79 all the way downward in the perspective of FIG. 4. An intermediate position of the valve 64 results in no flow between the pump 48 and the motor 68 but permits a drain through the conduit 81 to the reservoir 62.

Because the pump 48 is a variable displacement pump, the controller 65 can send a signal through the line 74 to increase or decrease the pressure of the fluid passing through the conduit 63 to the control valve 64. Thus, the controller 65 can send signals to the pump 48 to abruptly increase or decrease the pressure of the fluid flowing through the conduit 63 which ultimately controls the pressure of the fluid delivered to the hydraulic motor 68 which therefore controls the speed of the drum, tire or wheel 35, 36, 12.

It has been surprisingly found that varying the forward speed of a compactor 10, during a compaction process not only improves the quality of the compaction but, because the quality is improved, also improves the speed of the compaction or reduces the time in which the compaction operation may be completed.

Therefore, during a compaction operation, the controller 65 may send a signal through the line 74 to the pump 48 which will result in the drum, tire or wheel 35, 36, 12 rotating forward at a first speed. Then, periodically or randomly, the controller 65 may send a signal through the line 74 to the pump 48 which will either reduce or increase the speed of the drum, tire or wheel 35, 36, 12. The changes in wheel or drum speed may be frequent, infrequent, rhythmic, random or for the most part continuous depending upon the material to compacted. Again, it has been surprisingly found that varying the speed of the compactor 10, 30 during the compaction process while maintaining a forward or positive velocity, improves the compaction process and reduces the overall time needed for the compaction process.

As shown in FIG. 4, the variation or oscillation in compaction speed can be achieved hydraulically. As shown in FIG. 5, the variation or oscillation in compaction speed can also be achieved electrically. Turning to FIG. 5, a power source, prime mover or engine 32 is coupled to a generator 83 by a drive shaft 84. The generator 83 is linked to an electric motor 52 which, in turn, rotates the drive line or axle 69 which is linked to the drum or tire 35, 36, 12. The controller 65 is linked to the engine 32 by the line 85, to the generator 83 by the line 86 to the motor 52 by the line 87 and to the brake actuator 72 by the line 89. The generator 83 is linked to the motor 52 by the line 91.

The controller 65 can vary the current delivered to the motor 52 and therefore the speed of the motor 52 in a variety of ways. The controller may send a signal directly through the line 87 to the motor 52 to increase or decrease the speed of the motor and therefore the axle or drive lines 69. The controller 65 may also send a signal through the line 86 to the generator 83 to deliver more or less current through the line 91 to the motor 52.

Therefore, the controller 65 may send a signal for a constant or for an at least substantially constant propel command that propels the drums, tires or wheels 35, 36, 12 in a forward direction. The controller 65 may then send a second command or a second varying propel command to vary the speed of the drums, tires or wheels 35, 36, 12 to provide an oscillation or variation in the speed of the compactors 10, 30. The compactors 10, 30 need not come to a complete stop; all that is needed is an oscillation, variation or modification in the speed of the compactors 10, 30 on a regular, irregular, periodic or random basis.

Industrial Applicability

The compactors 10, 30 may be used to compact asphalt, soil or other granular materials for road construction, parking lot construction, building construction, or other projects that require the ground or a supporting surface to be compacted. As the compactors 10, 30 move forward during the compaction process, the controller 65 of either a hydraulic system 60 (FIG. 4) or an electric drive system 90 can enhance the compaction process by increasing and decreasing the speed of the rear tires 12 or drums 35, 36. The oscillation or variation in the speed of the compactors can be conducted rapidly over short distances while generally moving in one direction or in a forward direction. A rapid increase and decrease in compactor speed can cause the compactors to rock along there access of motion. The rocking action caused by the variation in compactor speed can be accomplished without an additional eccentric weight system. All that is needed is a modification to the controller 65 of the propel systems 60 or 90.

After a first signal is generated by the controller 65 and sent to the pump 48 (FIG. 4) or the generator 83 or motor 52 (FIG. 5), a second varying propel command may be superimposed over the first at least substantially constant propel command or the second propel command may be sent as a replacement for the first propel command. A variable or oscillatory compaction method described herein may be practiced on pneumatic-tire compactors 10 where conventional vibratory systems do not work and also on drum compactors 30 that may or may not be equipped with vibratory systems. The oscillation or variation in the compactor speed has a "kneading" effect on granular materials that result in a better settling of the particles for improved compaction. The compactors and methods disclosed herein are also applicable where vibratory systems would not be preferred because of the large vertical forces imposed by such systems. For example, using the disclosed methods on a bridge deck would be particularly appropriate if a vibratory system would impose vertical forces of an undesirable magnitude.

In summary, a disclosed method for compacting a surface includes providing wheeled compaction equipment, such as a pneumatic-tire compactor or a drum-type or asphalt compactor. The propel system is equipped with a controller that can provide a first at least substantially constant propel command that propels the compaction equipment in a forward direction. The controller then provides a second varying propel command to vary the speed of the equipment set by the first at least substantially constant propel command. As a result, the equipment maintains its forward motion despite variations in the forward speed of the equipment.

What is claimed is:

1. A method for compacting a surface, the method comprising:

providing wheeled compaction equipment;

providing a first at least substantially constant propel command that propels the equipment in a forward direction;

providing a second varying propel command to vary a speed of the equipment set by the first at least substantially constant propel command, wherein the second varying propel command is provided based on programming of the wheeled compaction equipment independent of any feedback of real time operating conditions of the surface, and wherein the equipment maintains its motion in the forward direction despite varying the speed of the equipment in the forward direction.

2. The method of claim 1 wherein the machine is pneumatic-tire compactor.

3. The method of claim 1 wherein the machine is drum-type compactor.

4. The method of claim 1 where the first at least substantially constant propel command provides an at least substantially constant pressurized flow of hydraulic fluid to a hydraulic motor that propels the wheeled compaction equipment forward.

5. The method of claim 4 wherein the second varying propel command provides a varying current to a control valve disposed upstream of the hydraulic motor that varies the flow of hydraulic fluid to the hydraulic motor to vary the speed of the equipment set by the first at least substantially constant propel command.

6. The method of claim 5 wherein the control valve is a proportional control valve.

7. The method of claim 1 wherein the second varying propel command provides a varying flow of hydraulic fluid to a hydraulic motor that propels the equipment forward to vary the speed of the equipment in the forward direction set by the first at least substantially constant propel command.

8. The method of claim 1 wherein the first at least substantially constant propel command provides at least substantially constant current to an electric motor that propels the equipment forward.

9. The method of claim 8 wherein the second varying propel command provides an varying current to the electric motor of the equipment to vary the speed of the equipment set by the first at least substantially constant propel command.

10. The method of claim 1 wherein the second varying propel command provides a varying current to an electric motor that propels the equipment forward to vary the speed of the equipment set by the first at least substantially constant propel command.

11. A hydraulically driven compactor, comprising:

at least two wheels for propelling the compactor and for compacting materials disposed beneath the wheels, the wheels in communication with a hydraulic motor, the hydraulic motor in communication with a control valve, the control valve in communication with a pump that is in communication with a hydraulic fluid reservoir, a controller for controlling flow through the control valve, the controller including a memory programmed with at least two commands including a first at least substantially constant propel command that propels the compactor in a forward direction and a second varying propel command to vary a speed of the compactor set by the first at least substantially constant propel command, wherein the memory is programmed to cause the controller to provide the second varying propel command to the control valve based on programming of the memory independent of any feedback of real time operating conditions of the material disposed beneath the wheels.

12. The compactor of claim 11 wherein the compactor is pneumatic-tire compactor.

13. The compactor of claim 11 wherein the compactor is drum-type compactor.

14. The compactor of claim 11 where the first at least substantially constant propel command provides an at least substantially constant pressurized flow of hydraulic fluid to a hydraulic motor that propels the wheeled compaction equipment forward.

15. The compactor of claim 14 wherein the second varying propel command provides a varying current to a control valve disposed upstream of the hydraulic motor that varies the flow of hydraulic fluid to the hydraulic motor to vary a speed of the compactor in the forward direction.

* * * * *